US005956795A

United States Patent [19]

Hirse

[11] Patent Number: 5,956,795

[45] Date of Patent: Sep. 28, 1999

[54] FLOOR CLEANING MOP AND SQUEEZING MECHANISM THEREFOR

[76] Inventor: Gernot Hirse, Franz-Simon-Strasse 29, 65934 Frankfurt, Germany

[21] Appl. No.: 09/030,134

[22] Filed: Feb. 25, 1998

[30] Foreign Application Priority Data

Feb. 26, 1997 [DE] Germany ..... 197 07 613

[51] Int. Cl.[6] ..... A47L 13/20

[52] U.S. Cl. ..... 15/119.1; 15/229.1; 15/260

[58] Field of Search ..... 15/119.1, 119.2, 15/228, 229.1, 229.2, 209.1, 244.1, 260, 263

[56] References Cited

U.S. PATENT DOCUMENTS

| | | | |
|---|---|---|---|
| 2,648,086 | 8/1953 | Vidal | 15/119.2 |
| 2,876,476 | 3/1959 | Woods | 15/244.1 |
| 3,253,290 | 5/1966 | Powers | 15/119.2 |
| 3,341,876 | 9/1967 | Campbell . | |

FOREIGN PATENT DOCUMENTS

| | | |
|---|---|---|
| 122 785 | 10/1984 | European Pat. Off. . |
| 330 543 | 6/1930 | United Kingdom . |

*Primary Examiner*—Terrence R. Till

*Attorney, Agent, or Firm*—Burns, Doane, Swecker & Mathis, L.L.P.

[57] ABSTRACT

A cleaning mechanism comprises a handle, a mop head connected to the handle, and a cleaning head of absorbent material (i.e., absorbent strips or a sponge, etc.) connected to the mop head and disposed beneath a lower surface thereof. A strainer mounted on a pail includes an upwardly facing surface, and a retainer lip for receiving an edge of the mop head to form a fulcrum about which the mop head can be swung for compressing the cleaning head between the upwardly facing surface of the strainer and the downwardly facing surface of the mop head. The downwardly facing surface of the mop head is of convex curvature when viewed in side elevation, and the upwardly facing surface of the strainer is of complementary concave curvature. This achieves a uniform squeezing of the cleaning head when the mop head is swung about the fulcrum to compress the cleaning head between the surfaces of the mop head and strainer.

8 Claims, 2 Drawing Sheets

FLOOR CLEANING MOP AND SQUEEZING MECHANISM THEREFOR

BACKGROUND OF THE INVENTION

The invention concerns a cleaning mechanism consisting of a cleaning device which incorporates a mop head with a cleaning head of absorbent mop material rigidly connected to a handle as well as a squeezing strainer mounted on a pail, whereby an edge of the mop head can be made to engage under a retainer bar on the edge of the squeezing strainer, in order to form a fulcrum for performing a squeezing motion of the mop head.

The squeezing of the cleaning mop serves to squeeze out the excess water absorbed during insertion of the cleaning mop into the pail. To do that, the edge of the mop head is hooked under the retainer bar on the edge of the squeezing strainer to form the fulcrum about which the mop head is swivelled by a swiveling movement of the handle. That causes the cleaning mop to be pressed between the lower side of the mop head and the strainer surface. In a known cleaning mechanism of this type (Campbell U.S. Pat. No. 3,341,876) the lower side of the mop head and the strainer surface are flat, as in other well known cleaning mechanisms. That results in an uneven squeezing of the overall cleaning mop (e.g., a sponge) during the swiveling movement of the mop head, because the portion of the mop spaced farthest from the fulcrum is compressed less than the portion located closest to the fulcrum. In addition, a relatively large movement of the handle is required to attain the required swiveling of the mop head.

The rigid connection of the handle to a mop head provided with a flat lower side dictates that a certain predetermined angle of the handle be maintained in relation to the surface to be washed. The handling of the cleaning device is thus made difficult, because the user must adapt his body position to this required handle position.

In order to achieve a parallel motion of the flat lower side of the mop head relative to the flat strainer surface, it is already known (British Patent 330,543) how to position the mop head on the handle by means of joints and how to incorporate, on an extension of the handle, an edge that engages under the retainer bar. The joint connection between the handle and the mop head, however, makes guiding and pressing of the mop head during the washing procedure difficult.

In another known cleaning mechanism (EPO-0 122 675) the mop head, incorporating a flat lower side, is connected to the handle by means of a universal joint, so that a parallel positioning of the mop head to the surface to be washed is guaranteed for any desired handle direction. As a result, however, a concentrated pressing a corner or edge of the cleaning mop against the surface to be washed is not possible. The squeezing strainer manifests a convex arched strainer surface on which the mop head can be rolled using a relatively expensive guide device, in order to improve the squeezing of the cleaning mop.

It is the task of this invention to achieve comfortable and effective handling of a cleaning mop during the washing procedure with a simple construction of the cleaning device and the squeezing strainer, on the one hand, and whereby an effective and uniform squeezing of the mop can be performed.

SUMMARY OF THE INVENTION

This task is solved by a cleaning mechanism comprising a handle, and a mop head connected to the handle and having a downwardly facing surface. A cleaning head of absorbent material is connected to the mop head and is disposed beneath the lower surface thereof. A strainer is adapted to be mounted on a pail for squeezing-out the cleaning head. The strainer includes an upwardly facing surface, and a retainer lip for receiving an edge of the mop head to form a fulcrum about which the mop head can be swung for compressing the cleaning head between the upwardly facing surface and the downwardly facing surface. The downwardly facing surface is of convex curvature, and the upwardly facing surface is of complementary concave curvature. As a result, a more uniform squeezing of the cleaning head occurs.

The convex arch of the lower side of the mop head bearing the cleaning mop facilitates and improves the handling of the cleaning device during the washing procedure. It is especially advantageous when the cleaning mop is firmly pressed on strip-shaped partial areas of the surface to be washed. As a result of the arching, a greater separation between the lower side of the mop head and the surface to be washed exists in the area before and behind the actual pressing location, so that there is less frictional resistance to movement of the cleaning head across the floor. Thus, the cleaning mop can be pushed across the surface to be washed, with less force. There thus results a high capacity to remove dirt. The required pressing force, however, is relatively low. These pressing relationships remain basically unchanged at various position angles of the handle, so that comfortable handling of the cleaning device is made possible. This supports the effect generally striven for in such cleaning devices, namely, a high degree of dirt removal at low friction resistance.

During the squeezing process the squeezing effect advances across the width of the mop head during the swiveling motion of the mop head. There thus results a good pressing effect with relatively low use of force.

Preferably the radii of curvature on the lower side of the mop head and the strainer surface become larger with increasing distance away from the swivel bearing. Thus the advancing pressing effect during the swiveling of the mop head is supported without any increase in the exerted force. At the same time, such a mop head whose curvature radius is smaller at the end opposite the grip handle than on the handle end is especially easily handled during the washing process.

The radius of curvature extends from an imaginary axis which extends perpendicularly to the axis of the handle when the mop head is viewed from the front.

The invention also pertains to a cleaning device per se.

BRIEF DESCRIPTION OF THE INVENTION

In the following section, preferred embodiments of the invention are described in more detail and are shown in drawings.

DETAILED DESCRIPTION OF PREFERRED EMBODIMENTS OF THE INVENTION

Figure 1:
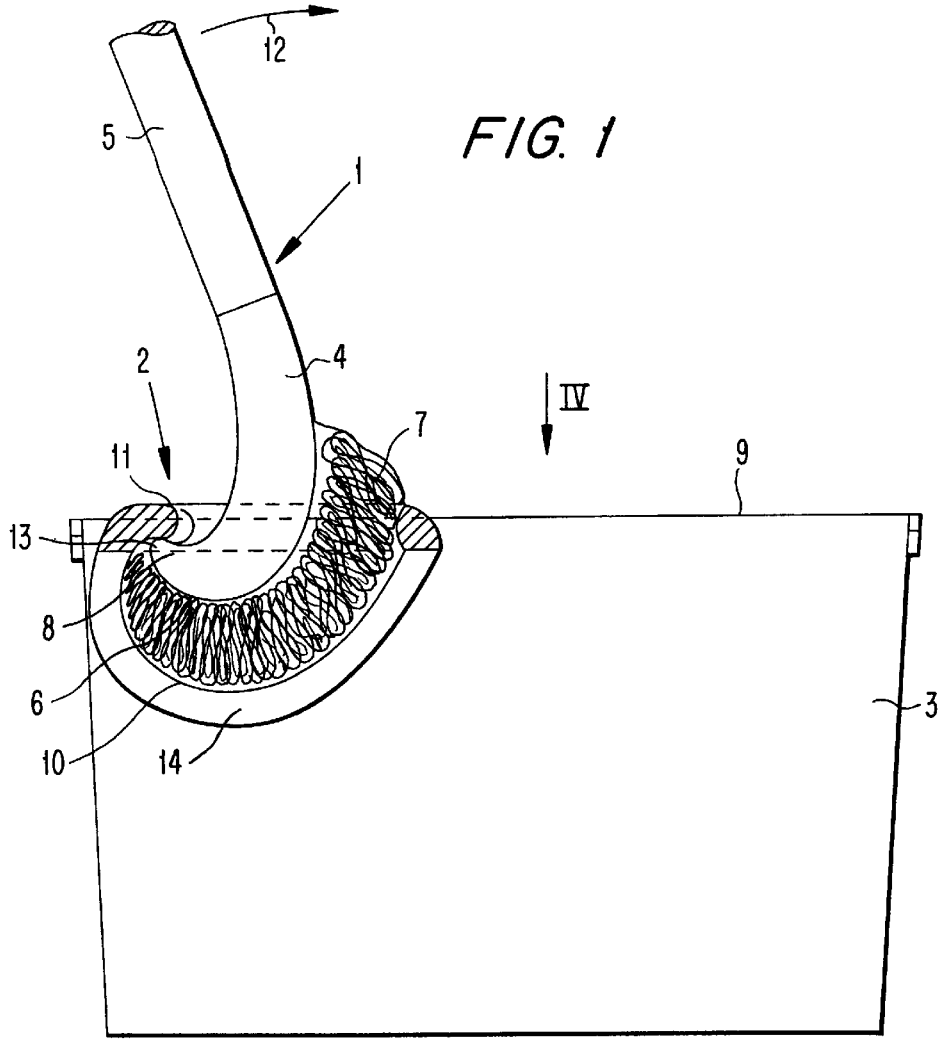
FIG. 1 depicts a cleaning device according to the invention at the start of a squeezing process in a squeezing stainer which is mounted in a pail, the cleaning device shown in a side elevational view, and the squeezing strainer and the pail shown in cross section.

The first preferred embodiment of a cleaning mechanism is shown in FIGS. 1–4 and comprises a cleaning device 1 and a squeezing strainer 2 which is mounted on the top edge of a pail 3. The cleaning device 1 includes a mop head 4 which is rigidly connected to a handle 5. A cleaning head or cleaning mop 7 is attached to the lower side 6 of the mop head 4 and comprises absorbent material, for example textile material of fibers, strips or rags. Instead of that, however, the cleaning mop 7 can also comprise a sponge or other absorbent, ductile material.

The downwardly facing lower side 6 of the mop head 4 that carries the cleaning mop 7 is arched in a convex manner when viewed in side elevation (FIG. 1), and its free end opposite the grip handle 5 is defined by an edge 8 which runs crosswise to the direction of the handle.

Figure 2:
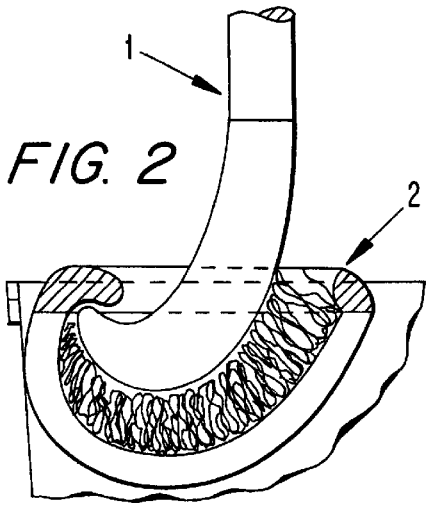
FIG. 2 shows the cleaning device and squeezing strainer of FIG. 1 during a squeezing process already in progress.
Figure 3:
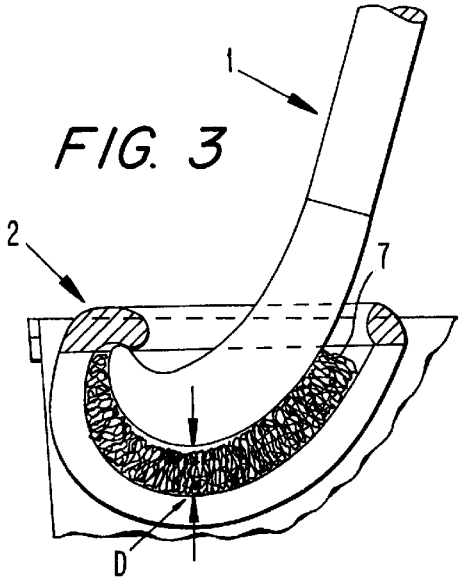
FIG. 3 depicts the cleaning device and squeezing strainer at the end of the squeezing process.

The squeezing strainer 2 that is mounted on the upper edge of the pail 3 includes an upwardly facing strainer surface 10 which is arched in a concave manner when viewed in side elevation. Formed on the upper edge of the squeezing strainer 2 at one end of the strainer surface 10 is a retainer lip 11 that is bent downward in its cross-section and under which the edge 8 of the mop head 4 engages in the squeezing process, as shown in FIGS. 1–3. During a swivel motion of the handle 5 in the direction of arrow 12, the lower side of the retainer lip 11 forms a swivel fulcrum 13, about which the mop head 4 can be swivelled. As one can see from FIGS. 1–3 which represent the successive stages of the squeezing procedure, the mop head 7 is increasingly pressed during the swiveling of the handle 5 in the direction of arrow 12 against the strainer surface 10 whose concave arch matches the convex arch of the lower surface 6 of the mop head 4. The lower surface 6 and the strainer surface 10 are thus shaped in a manner complementary to each other, so that the cleaning mop 7 an the end of the squeezing process (FIG. 3) is compressed in a squeezing slit of generally uniform depth D formed between these two surfaces 6, 10 (see FIG. 3).

The arching on the lower side of the mop head 4 and the strainer surface 10 is configured such that the radius of curvature thereof is smallest in the vicinity of the swivel fulcrum 13 and becomes larger with increasing distance away from the swivel fulcrum 13.

Figure 1A:
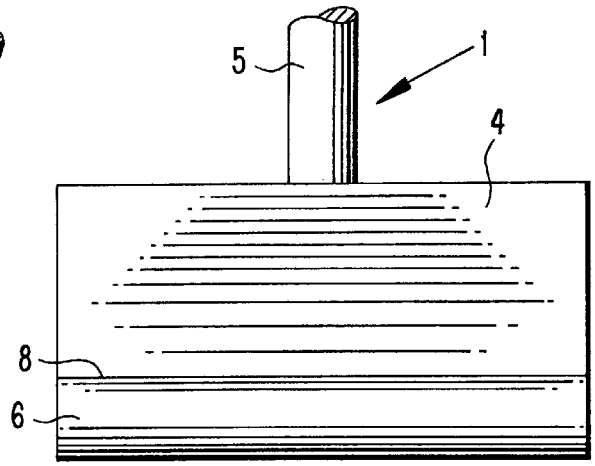
FIG. 1A is a front elevational view of the mop head of FIG. 1.

The radius of curvature of the surfaces 6 and 10 extends from an imaginary center axis extending perpendicular to the handle axis as the mop head is viewed from the front (FIG. 1A). In the case of a non-constant curvature described above, the location of that axis may continuously change.

Figure 5:
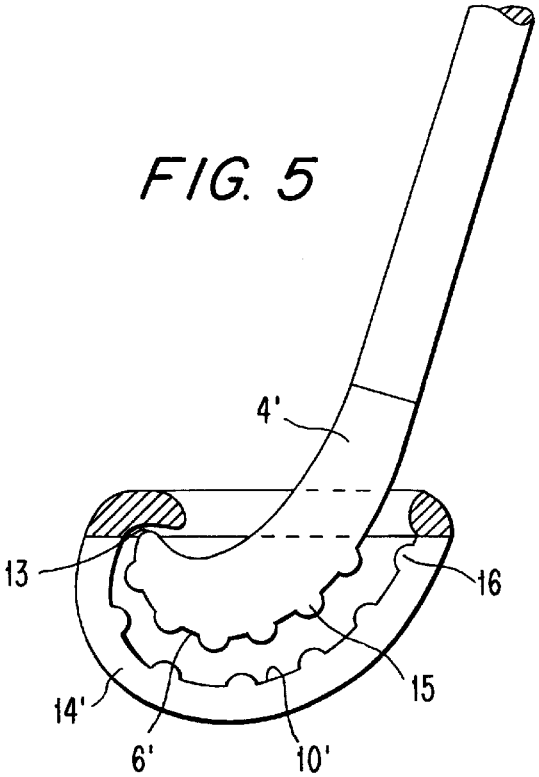
FIG. 5 depicts a modified version of the cleaning device and squeezing strainer in a drawing similar to FIG. 3, whereby the cleaning mop and pail are not shown.
Figure 4:
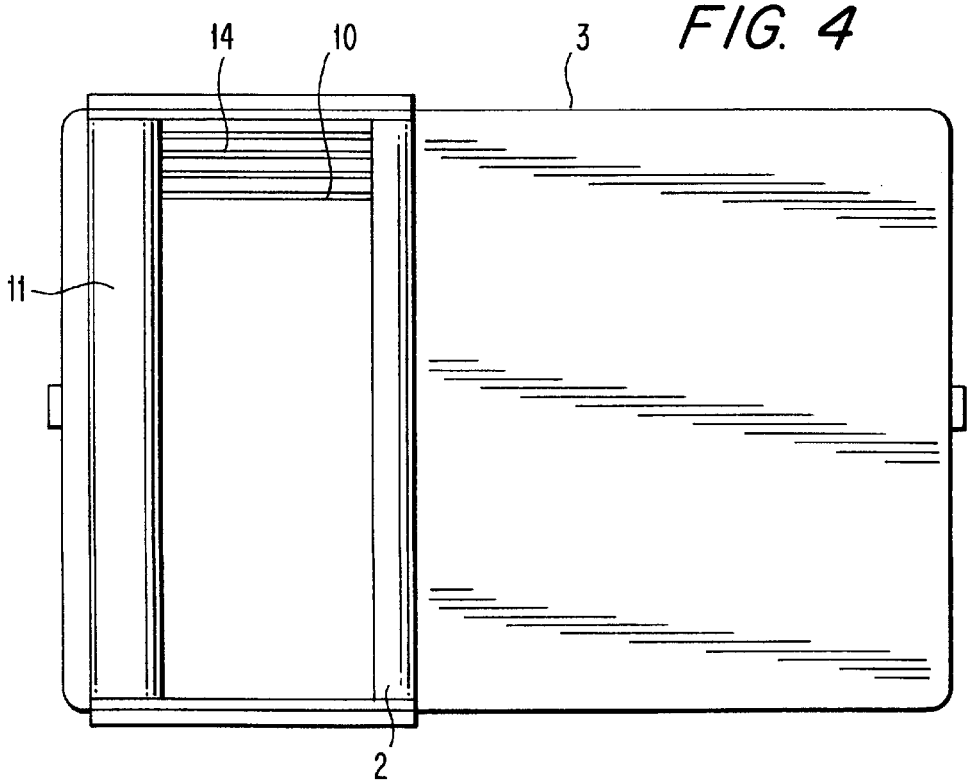
FIG. 4 is a top plan view in the direction of arrow IV in FIG. 1, depicting the pail and strainer, but with the cleaning device removed.

As one can especially recognize in FIG. 4, the strainer surface 10 comprises strainer rods 14 or ribs which run parallel to each other and crosswise to the above mentioned surface lines and thus crosswise to the swivel fulcrum 13. These strainer rods 14 or ribs can be constructed in a flat manner, as shown in FIGS. 1–4. Instead of that, however, it is also possible, as shown in FIG. 5, to incorporate ribs 15 and 16 or knobs running crosswise on the lower side 6' of the mop head 4' and/or the strainer surface 10' of rods 14', in order to reinforce the squeezing effect on the cleaning mop accepted in between them.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cleaning mechanism comprising:

a handle;

a mop head connected to the handle and having a downwardly facing surface;

a cleaning head of absorbent material connected to the mop head and disposed beneath the lower surface thereof; and a strainer adapted to be mounted on a pail for squeezing-out the cleaning head, the strainer including an upwardly facing surface, and a retainer lip for receiving an edge of the mop head to form a fulcrum about which the mop head can be swung for compressing the cleaning head between the upwardly facing surface and the downwardly facing surface;

the downwardly facing surface being of convex curvature when viewed in side elevation, and the upwardly facing surface being of complementary concave curvature when viewed in side elevation.

2. The cleaning mechanism according to claim 1 wherein the downwardly facing surface has a radius of curvature which increases in a direction away from the edge, and the upwardly facing surface has a radius of curvature which increases in a direction away from the retainer lip.

3. The cleaning mechanism according to claim 2 wherein the strainer comprises parallel ribs extending perpendicular to the lip, as the strainer is viewed from above.

4. The cleaning mechanism according to claim 2 wherein at least one of the downwardly facing surface and the upwardly facing surface includes projections protruding toward the other of the downwardly facing surface and the upwardly facing surface.

5. The cleaning mechanism according to claim 2 wherein the radius of curvature extends from an axis extending perpendicular to an axis of the handle as the cleaning head is viewed from the front.

6. The cleaning mechanism according to claim 1 wherein the strainer comprises parallel ribs extending perpendicular to the lip, as the strainer is viewed from above.

7. The cleaning mechanism according to claim 1 wherein at least one of the downwardly facing surface and the upwardly facing surface includes projections protruding toward the other of the downwardly facing surface and the upwardly facing surface.

8. The cleaning device according to claim 1 wherein the downwardly facing surface has a radius of curvature which increases in a direction away from an edge of the mop head.

* * * * *